US007494585B2

(12) United States Patent
Nino

(10) Patent No.: US 7,494,585 B2
(45) Date of Patent: Feb. 24, 2009

(54) LARGE AREA CATCH BASIN FILTER

(76) Inventor: Khalil Ibrahim Nino, P.O. Box 2294, South Gate, CA (US) 90280

( * ) Notice: Subject to any disclaimer, the term of this patent is extended or adjusted under 35 U.S.C. 154(b) by 0 days.

(21) Appl. No.: 10/934,854

(22) Filed: Sep. 3, 2004

(65) Prior Publication Data

US 2005/0051499 A1 Mar. 10, 2005

Related U.S. Application Data

(60) Provisional application No. 60/500,842, filed on Sep. 4, 2003.

(51) Int. Cl.
*E03F 5/06* (2006.01)
*E03F 5/14* (2006.01)

(52) U.S. Cl. ..... 210/155; 210/162; 210/163; 210/170.03; 404/4

(58) Field of Classification Search ..... 210/747, 210/767, 155, 162, 163, 164, 170.03; 404/4, 404/5

See application file for complete search history.

(56) References Cited

U.S. PATENT DOCUMENTS

| | | | | |
|---|---|---|---|---|
| 22,209 | A | 11/1858 | Van Dusen | |
| 122,209 | A | 12/1871 | Ashman et al. | |
| 231,544 | A | 8/1880 | Darst | |
| 248,559 | A | 10/1881 | Jackson | |
| 658,639 | A | 9/1900 | Guion | |
| 664,945 | A | 1/1901 | Guion | |
| 783,556 | A * | 2/1905 | Van Buskirk | 404/5 |

(Continued)

OTHER PUBLICATIONS

Khalil Nino (applicant herein); no title; 1 page with 2 photos showing hanging flexible mesh basket type inserts located inside a catch basin; presently uncertain of exact date, but believed taken in or about Jul. of 2003 of devices that had been installed prior to that date in Los Angeles county. (See, e.g., U.S. Pat. #6106707, previously cited herein, for a hanging basket type insert that appears similar in many respects but has a hard hopper shell that contains absorbent materials).

(Continued)

*Primary Examiner*—Christopher Upton
(74) *Attorney, Agent, or Firm*—Aaron L. Patton

(57) ABSTRACT

The present invention relates to an apparatus for maximizing the blockage of fluid borne solid materials from passage through a catch basin into the downstream parts of a fluid flow channel, with minimum impact on the volume and rate of fluid passing through the channel. The apparatus comprises at least one filter sheet secured within the catch basin at a location above and covering a large proportion of the floor of the catch basin, an overflow wall separating the filter area from an unfiltered overflow area, and a diverter for directing incoming trash away from the overflow area and to the filter side of the overflow wall. Although the apparatus covers a large area within the catch basin, the overflow wall, overflow area, and clearance between the filter sheet(s) and the floor provide sufficient space for fluid and excess trash to pass in the event the capacity of the apparatus for holding them is exceeded. Preferably, the apparatus also has a drain-access hole through the filter sheet(s) and a movable hole cover located appropriately to facilitate access to the catch basin drain.

29 Claims, 8 Drawing Sheets

U.S. PATENT DOCUMENTS 809,201 A 1/1906 Lutz
1,035,480 A 8/1912 Schodde
1,041,887 A * 10/1912 Schodde ..... 210/163
1,066,316 A 7/1913 Piper
1,302,839 A 5/1919 Olson
1,349,734 A 8/1920 Riley
1,666,756 A 4/1928 Sass
1,746,121 A 2/1930 Levy
1,999,637 A 4/1935 Pettepher
2,102,310 A 12/1937 Egan
2,182,795 A * 12/1939 Day ..... 210/164
2,615,526 A 10/1952 Lane
2,796,988 A 6/1957 Loffler
3,282,430 A 11/1966 Kinne
3,628,668 A 12/1971 Huppert
4,261,823 A 4/1981 Gallagher
4,419,232 A 12/1983 Arntyr et al.
4,798,028 A 1/1989 Pinion
5,069,781 A 12/1991 Wilkes
5,133,619 A 7/1992 Murfae et al.
5,139,364 A 8/1992 Takahashi et al.
5,223,154 A 6/1993 MacPherson, Jr. et al.
5,232,587 A 8/1993 Hegemier et al.
5,284,580 A 2/1994 Shyh
5,297,367 A 3/1994 Sainz
5,322,629 A 6/1994 Stewart
5,372,714 A 12/1994 Logue
5,403,474 A 4/1995 Emery
5,405,539 A 4/1995 Schneider
5,624,576 A 4/1997 Lenhart et al.
5,643,445 A 7/1997 Billias et al.
5,707,527 A 1/1998 Knutson et al.
5,720,574 A 2/1998 Barella
5,744,048 A 4/1998 Stetler
5,779,888 A 7/1998 Bennett
5,849,181 A 12/1998 Monteith
5,902,477 A 5/1999 Vena
5,904,842 A 5/1999 Billias et al.
5,925,242 A 7/1999 McGhee
5,958,226 A 9/1999 Fleischmann
6,027,639 A 2/2000 Lenhart, Jr. et al.
6,062,767 A 5/2000 Kizhnerman et al.
6,080,307 A 6/2000 Morris et al.
6,086,758 A 7/2000 Schilling et al.
6,096,200 A 8/2000 Bennett
6,106,706 A 8/2000 Roy et al.
6,106,707 A 8/2000 Morris et al.
6,165,354 A 12/2000 Thomas
6,171,023 B1 1/2001 Townshend
6,200,484 B1 3/2001 McInnis
6,217,756 B1 4/2001 Martinez
6,217,757 B1 4/2001 Fleischmann
6,231,758 B1 5/2001 Morris et al.
6,241,882 B1 6/2001 Allard
6,258,268 B1 7/2001 Lake
6,270,662 B1 8/2001 Gibson
6,270,663 B1 8/2001 Happel
6,287,459 B1 9/2001 Williamson
6,294,095 B1 9/2001 Lewis
6,368,499 B1 4/2002 Sharpless
6,478,954 B1 11/2002 Turner, Jr. et al.
6,531,059 B1 3/2003 Morris et al.
6,551,023 B2 4/2003 Allard
6,562,233 B1 5/2003 Schilling et al.
6,609,852 B2 8/2003 Wimberger
6,649,048 B2 11/2003 de Ridder et al.
6,666,974 B2 * 12/2003 Page ..... 210/747
6,668,390 B1 12/2003 Gonzalez
6,676,832 B2 1/2004 de Bruijn et al.
6,733,665 B1 5/2004 Khalil
6,793,811 B1 9/2004 Fleischmann
6,797,162 B2 9/2004 Happel
6,824,677 B2 11/2004 Martinez
6,872,029 B2 3/2005 Allard et al.
6,884,343 B2 4/2005 Harris et al.
6,905,599 B2 6/2005 Allard
6,974,540 B1 12/2005 Fleischmann
6,976,808 B2 12/2005 Allard
6,986,621 B2 1/2006 Allard
6,998,038 B2 2/2006 Howard
6,998,039 B2 2/2006 Harris et al.
7,040,838 B2 5/2006 Allard et al.
7,083,721 B2 8/2006 McClure et al.
7,163,635 B2 1/2007 Fitzgerald
7,182,874 B2 2/2007 Allard et al.
7,270,747 B2 9/2007 Happel et al.
7,294,256 B2 11/2007 Happel et al.
2002/0113025 A1 8/2002 Gauldin et al.
2002/0121466 A1 9/2002 McDermott et al.
2003/0047497 A1 3/2003 Harris et al.
2003/0094407 A1 5/2003 deRidder et al.
2003/0132150 A1 * 7/2003 Happel ..... 210/163
2003/0136717 A1 * 7/2003 Tseng ..... 210/163
2004/0128903 A1 7/2004 Wexler
2004/0173513 A1 9/2004 Nino
2004/0226869 A1 11/2004 McClure et al.
2004/0251185 A1 12/2004 Pitt et al.
2005/0035038 A1 2/2005 Fallon
2006/0231508 A1 10/2006 Marzett et al.
2006/0231509 A1 10/2006 Marzett

OTHER PUBLICATIONS

Aaron L. Patton (attorney herein); 2 letters (cover letter correcting address and enclosing the principal letter) to City of Los Angeles attention Juan A. Benitez; subject: Request for Quotation (RFQ) No. 1519 "Catch Basin Inserts & Installation," etc.; cover letter dated Jan. 20, 2005, principal letter dated Jan. 19, 2005; 2 pages, 1 for each letter since the principal letter's enclosures--copy of Filing Receipt and U.S. Appl. No. 10/934,854 (informally referred to as "[a] copy of the subject invention")-are believed to be already on file herein.

Philip H. Lam (Intellectual Property Attorney, Office of The City Attorney, City of Los Angeles); letter dated Feb. 8, 2005, titled Co-Inventorship Issues, etc., with an enclosure identified as a copy of Response by Practical Technology to RFQ #869 (see RFQ #689 below); letter being 2 pages (see below re pages for the RFQ #869 enclosure).

City of Los Angeles; Request for Quotation (RFQ) #869 for Annual Requirements: Catch Basin Filter Insert & Trash Monitorings; dated Nov. 13, 2002; 38 pages (although, the number of pages provided here is reduced to 13 in an effort to minimize unnecessary volume and focus on the pages most relevant to the proposed work. Prices were redacted for privacy.).

City of Los Angeles; Request for Quotation (RFQ) #1519 for Catch Basin Inserts & Installation, dated Nov. 30, 2004, 139 pages (although, the number of pages provided here is reduced to 45 in an effort ro minimize unnecessary volume and focus on the pages most relevant to the proposed work. Prices were redacted for privacy, as were phone/fax/email information of meeting attendees.).

Aaron L. Patton; 2-page letter to Philip H. Lam re Request for Quotation (RFQ) No. 1519 "Catch Basin Inserts & Installation," etc., dated Feb. 17, 2005. (The specification referred to was a standard pre-printed form, see below, believed intended for use in all LA City catch basin filter insert contracts, although it may have simply not been included in RFQ #869.).

City of Los Angeles; Specifications For Catch Basin Filter Inserts and Trash Monitoring Services; 3 pages; original date of publication unknown but received by Aaron L. Patton on about Feb. 16, 2005 for Khalil Nino who is believed to have received it at about that time from City of Los Angeles personnel; believed published in the City of Los Angeles on and printed by City personnel from the City's internal web cite shown in the bottom margin of the document.

Aaron L. Patton; hand-written telephone note (original is on a note pad that has advertising graphics on it, which advertising graphics was removed from the copy provided here); titled T/C from Philip Lam, dated Feb. 18, 2005; one page. (The author is not aware of receiving any further communication on this subject from Mr. Lam or at his request.).

Christopher Upton; Non-Final Office Rejection dated Feb. 26, 2007; office action rejecting all claims in U.S. Appl. No. 11/110,191 (Marzett), which application appears to have claims similar to those in the published application herein; copy of the Office Action available in the PAIRS file for this '191 Marzett application.

Christopher Upton; Requirement for Restriction/Election dated Apr. 20, 2007 requiring election between claims and correction of Oath of Declaration, in U.S. Appl. No. 11/110,192 (Marzett), which application appears to have claims similar to those in the published application herein and to name applicant herein as a joint inventor; copy of the Requirement already available in the PAIRS file for this '192 Marzett application.

Correction to Item #3 in IDS Filed Sep. 18, 2007. The letter referred to in the IDS, the Philip H. Lam letter, is described in item #3 of that IDS as dated Feb. 8, 2005 (which is believed to be the correct date of the letter although the date shown on it is Feb. 8, 2004-see, e.g., mention of this in the Aaron L. Patton letter dated Feb. 17, 2005 referred to in item #6 of the IDS), so the statement "letter dated Feb. 8, 2005" in item #3 in the IDS filed Sep. 18, 2007 should be corrected to read: "letter dated Feb. 28, 2004 (although correct date is believed to be Feb. 8, 2005)".

Khalil Nino (applicant herein); no title; 4 pages, each a photo, showing hanging flexible mesh basket type inserts located inside a catch basin; all photos believed taken in or about Jul. of 2003, of devices installed sometime prior to that date in Los angeles county. (The statements here, below, and in item 1 in the IDS filed Feb. 18, 2007, relate to photos taken (authored) by applicant and therefore are based on information provided by him which is believed true.) (All photos were taken in color but are provided herewith in black & whtie.).

Khalil Nino (applicant herein); no title; 8 pages, each a photo selected by applicant from a collection of photos taken during his installations in curb inlet catch basins of large-area filter inserts ("strainets") with some photos showing structural support pieces without filter sheets installed and others showing filter sheets forming bottom, overflow wall, and diverter portions; it is believed all these photos were taken in or about Apr.-May 2003 in the City of Los Angeles, in connection with performance of work relating to RFQ #869 (see item #4 in IDS filed herein on Sep. 18, 2007).

Khalil Nino (application herein); no title; 5 pages, each a photo selected by applicant from a collection of photos taken during his installations in top inlet catch basins of large-area filter inserts ("strainets") with one photo showing structural support pieces without filter sheets installed and others showing filter sheets that form bottom, overflow wall (not visible), and diverter portions; it is believed all these photos were taken in or about Apr. of 2003 in the City of Los Angeles, in connection with performance of work relating to RFQ #869 (see item #4 in IDS filed herein on Sep. 18, 2007).

Khalil Nino (applicant herein); no title; 3 pages, each a photo of applicant's first version of a large-area filter insert, showing its bottom, overflow wall, and diverter (between vertical support and folded back portion of overflow wall); all photos believed taken Dec. 17, 2002 in City of LA of this installation which was done by applicant about 1 day before its demonstration to LA City & County personnel on or about Sep. 12, 2002. (Other demo installations, more similar to those referred to in item 3 above, were done by applicant in the City of LA in or about the months of Oct. - Nov. 2002.).

County of Los Angeles Department of Public Works, Watershed Management Division, Water Quality Section; "Technical Report on Trash Best Management Practices"; pub. presumed about dated of report, Aug. 5, 2004 (but pdf file says created & modified Aug. 9, 2004 & notes rev. Jul. 22, 2004); title pg. & pp. 3 (inserts, separators & socks), 8 (para. 3-4), 10 (para. 1), 13-14 (inserts, separators, & socks & screens); pub. at http://www.ladpw.org/wmd/BMP/TrashTechReport/TrashTechnical ReportFinal8-5-04.pdf, presumed by author from LA, CA. (Copy filed herewith.).

Miriam Gordon & Ruth Zamist; "Municipal Best Management Practices for Controlling Trash and Debris in Stormwater and Urban Runoff"; pub. date presumed 2006 per ref. in NPL item #7 of IDS filed herein on Sep. 8, 2008; cover & title (author) pgs & pp. 4, 8-10, 13-19, 22-26 (struct. controls & notes 6 & 14), 47-55 (Appxs. 2 & 3, devices, vendors & some install. data), & 56-57 (sources & dates); published at http://www.plasticdebris.org/Trash_BMPs_for_Munis.pdf; presumed pub. by Plastic Debris Rivers to Sea Project from Long Beach, CA. (Copy filed herewith.).

United Storm Water Inc.; "Protecting Our Water Resources"; a brochure; pp. 3 ("DrainPac™ Facts," incl. ref. to Pat. #6086758), 4 ("DrainPac™ Specifications"), 5 ("DrainPac™ Filter Insert Variations") & 6 ("DrainPac™ Analytical Data," with ref. to test dates); pub. date unknown, but viewed as pdf file on internet about Feb. 2008 & pdf's Properties window says file created & modified on Apr. 9, 2007; pub. at http://www.unitedstormwater.com/brochure%20website/usw_new.pdf; presumed pub. by author from Los Angeles (City of Industry), CA. (Copy filed herewith.).

Revel Environmental Manufacturing Inc.; products introduction pages re REM's filter inserts, including Triton Curb Inlet Filter™ Inserts, Geo-Trap Catch Basin Filter™ Inserts & Triton Catch Basin Filter™ Inserts; 2 pgs.; pub. dated unknown, but viewed as pdf file on internet about Feb. 2008 & pdf's Properties window says pdf file created Jan. 7, 2004 & modified Mar. 3, 2004; published at http://www.remfilters.com/uploads/products/b315d0fc33ae523281aaafa320845997-line-card-3-04.pdf; presumably by author from Concord or Santa Ana, CA. (Copy filed herewith.).

Revel Environmental Manufacturing Inc.; "Triton Filter™ Curb Inlet Filter Insert Product Specification"; company product brochure for its Triton™ curb inlet filters; 2 pages; pub. date unknown, but viewed as pdf file on internet about Feb. 2008 & pdf's Properties window says pdf file created & modified May 7, 2007; published at http://www.remfilters.com/uploads/products/Curb-inlet-05-07.pdf; presumed pub. by author from Concord of Santa Ana, CA. (Copy filed herewith.).

City of Los Angeles, Department of Public Works, Bureau of Sanitation, Watershed Protection Division; "High Trash-Generation Areas and Control Measures"; pub. date presumed Jan. 2002 (bottom margin of p. 8 notes "Rev. Jan. 11, 2002"); title pg. and pp. 8 (rev. date in bottom margin), 16-18 & 21-23 (structural trash control systems, incl. inserts, separators & nets/screens); published at http://www.lacity.org/san.wpd/siteorg/download/pdfs/reports/Trash_Gen_Study.pdf; presumed pub. by author from LA, CA. (Copy filed herewith.).

City of Los Angeles, Watershed Protection Division; "Trash Reduction Pilot Study #A1 End-of-Pipe Trash Systems"; pub. date presumed about Aug. 22, 2002 per footnote on each page (but viewed as pdf file on internet about Jun. 2008 & pdf's Properties window says pdf file created Jun. 28, 2004 & modified Dec. 27, 2006); pp. 1-8 (references to screen barriers and baskets in use and to related dates); published at http://www.lacity/org/SAN/Wpd/Siteorg/download/pdfs/reports/Pilot%20Study_A1_final_doc.pdf; presumed pub. by author from LA, CA. (Copy filed herewith.).

Rita L. Robinson, Dir. Bur. of Sanitation, City of LA; "Request For Full Capture Certification Of A Catch Basin Insert"; letter to Jonathan Bishop, Exec. Officer LA Reg'l. Water Qual. Contr. Bd.; dated Oct. 19, 2006 & presumed pub. soon thereafter (but viewed as pdf file on internet Sep. 8, 2008 & pdf's Properties window says pdf file created May 14, 2007 & modified May 18, 2007); pp. 1-2; published at http://www.waterboards.ca.gov/losangeles/water_issues/programs/tmdl/fcc/letter%20rb%20cert%20request.pdf; presumed pub. by LARWQCB from LA, CA. (Copy filed herewith.).

City of Los Angeles, Watershed Protection Division; "Catch Basin Inserts: Method to Determine CB Inserts Acts as Full Capture Devices"; white paper attached to the letter identified in NPL item 8 above (apparently the Attachment A referred to in that letter); published on internet with said letter as part of same pdf file (so description in above NPL item 8 re pub. date, internet address, publisher, and place of pub. apply here as well); title pg. and pp. 1-1 to 1-4 & 1-6 to 1-9. (Copy filed herewith.).

City of Los Angeles, Watershed Protection Division; "Technical Report: Assessment of Catch Basin Inserts"; white paper attached to the letter identified in NPL item 8 above (apparently the Attachment B referred to in that letter); pub. on internet with said letter as part of same pdf file (so description in said item 8 re pub. date, internet address, publisher, and place of pub. apply here as well) (but note that this attachment is dated "Jun. 2006" & marked "Revised Feb. 21, 2007"); title pg. and pp. ES-1, ES-2, 1-1 to 1-3, 1-7, 2-1, 3-1, 3-4, 3-5 & 4-4. (Copy filed herewith.).

Abtech Industries; "Smart Sponge® Technology for BMP Solutions"; pub. date of content unknown (web pg. accessed in about Feb. 2005 and says copyright 2005); 1 web pg. (3 print pgs.), depicting & describing Smart Sponge® Technology devices (seems similar to Pat. #6106707 & #6231758, issued Aug. 22, 2000 & May 15, 2001) and Ultra-Urban Filter® device (seems similar to Pat. #6531059 issued Mar. 11, 2003); published on internet, believed at http://www.abtechindustries.com; presumed published by author from Scottsdale, AZ. (Copy filed herewith.).

American Storm Water; "We are Committed to the Cleaner, Safer Future"; pub. date of content unknown (web pg. accessed on about Jan. 2008 but says copyright 2006); 1 web pg. (2 print pgs.), depicting man apparently in catch basin installing frame for (presumably) Catch-All catch basin screen; published on internet at http://www.american stormwater.com/American_Storm_Water/index.html; presumed published by author at Torrance, CA. (Copy filed herewith.).

American Storm Water; "Catch-All's Sturdy Design & Scalability Allows Each Catch Basin To Be Custom Fit"; pub. date of content unknown (web pg. accessed in about Jan. 2008 but says copyright 2006); 1 web pg. (2 print pgs.), depicting and describing Catch-All catch basin screen apparently as installed in a catch basin; published on internet at http://www.americanstormwater.com/Storm_Water_Products/catch_all.html; presumed published by author at Torrance, CA. (Copy filed herewith.).

American Storm Water; "Debris Dam's Catch Basin Screen Technology Is Proven To Remove Trash & Organic Debris"; pub. date of content unknown (web pg. accessed in about Jan. 2008 but says copyright 2006); 1 web pg. (2 print pgs.), depicting and describing Debris Dam apparently as installed in a catch basin; published on internet at http://www.americanstormwater.com/Storm_Water_Products/debris_dam.html; presumed published by author at Torrance, CA (Copy filed herewith.).

EPA New England's Center for Environmental Industry and Technology (CEIT); Innovative Technology Inventory (ITI) Kristar FloGard Dual-Vortex Hydrodynamic Separator (DVS); pub. date of content unknown (web pg. accessed in about Feb. 2008 but says last updated Sep. 13, 2007); 1 web pg. (4 print pgs.), depicting and describing Flogard hydrodynamic separator; published on internet at http://www.epa.gov/NE/assistance/ceit_iti/tech_cos/kristar_floguardDVS.html; presumed published by author at Boston, MA. (Copy filed herewith.).

Kristar Enterprises Inc.; "FloGard Dual-Vortex Hydrodynamic Separator the Only Hydrodynamic Separator with a Dual-Vortex Design"; pub. date of content unknown (web pg. accessed in about Feb. 2008 but says copyright 2005); 1 web pg. (2 print pgs.), depicting and describing FloGard Dual-Vortex Hydrodynamic Separator; published on internet at http://www.kristar.com; presumed published by author at Santa Rosa, CA. (Copy filed herewith.).

Santa Clara Valley Urban Runoff Pollution Prevention Program; "Screens and Racks"; part of Trash BMP Tool Box dated Sep. 2007 (presumed to be pub. date); pp. 1-9 (references to inline screening devices of various types indicating that some may have existed prior to 2002, noting on p. 5 that some were tested during 2000-2002, and p. 10 (ref. to sources & dates); pub. on internet, http://www.scvurppp-w2k.com/trash_bmp_toolbox_2007/Screen%20&%20Racks.pdf, presumed pub. by author from Sunnyvale, CA. (Copy filed herewith.).

* cited by examiner

LARGE AREA CATCH BASIN FILTER

CROSS-REFERENCE TO RELATED APPLICATIONS

This application is derived from U.S. Provisional Application No. 60/500,842, filed Sep. 4, 2003, and claims priority based upon the filing date of said Provisional Application.

BACKGROUND OF THE INVENTION

The present invention relates to an apparatus for installation into a drainage catch basin or similar structure (referred to herein simply as catch basin) for blocking the passage of solid materials that enter the catch basin while permitting the passage of fluid into the downstream elements of the drainage system, such as a drainage pipe or other channel. More particularly, the present invention relates to such an apparatus that also permits the overflow of fluid and excess accumulation of solid materials under circumstances wherein the flow of fluid and possibly additional solid materials into the catch basin exceeds the capacity of the apparatus.

As used in this specification, "solid material" means any item of natural or man-made solid material, including any comprised of trash, debris, vegetation, one or more sticks, one or more rocks, all or part of an animal, or any combination thereof, that is larger than a predetermined maximum size. Such solid material is also referred to herein singly and plurally simply as "trash." The predetermined maximum size of solid material that will be permitted to pass through an aperture is often based on use of a hypothetical model of the solid material. The hypothetical model typically is a spherical shape that is rigid (neither elastic nor flexible). Of course, many forms of solid material are not spherical in shape or are not rigid; and those solid materials can sometimes pass through an aperture that is smaller than the solid material's maximum dimension, which may be due to the solid material's orientation upon reaching the aperture or to its compressibility or flexibility. Thus, an aperture that is intended to block solid materials of a predetermined maximum size should not be expected to stop all solid materials that are equal to or larger than that size.

Fluid flow channels, particularly drainage channels, often include a catch basin. The catch basin is typically located near the channel's beginning point; that is, near the point at which fluid first enters the channel system. However, catch basins may be located anywhere in the channel system that is deemed appropriate by the owner and/or designer of said system.

As used in this specification, "fluid" means any fluid, or combination of fluids, that is normally or reasonably expected to enter the catch basin in which the apparatus is installed.

Solid materials tend to be moved by fluid and thereby enter into drainage channels, which channels then collect or direct the flow of the fluid. It is generally desirable to minimize the amount of solid materials in the channel that are too large for the channel to move throughout its length during light, moderate, or, in some cases, even maximum flow periods. It is also desirable to minimize the amount of solid materials that pass through the channel and are large enough to create an environmental, aesthetic, health, or other problem at the discharge end of the channel. On the other hand, it is desirable for channels to be available for receiving and moving large amounts of fluid during heavy flow periods. The need for these desirable features is particularly apparent when considered in the context of a street or highway storm drain system.

Streets and highways frequently have curb inlets or surface grates that permit fluid and trash to enter the catch basin, where the trash can thereafter pass into their extended drainage systems, which are typically intended to carry the fluid and, to the extent practical, the trash to an outfall, treatment facility, or other termination or intermediate point. When the trash enters into the extended drainage system, it tends to become lodged and to block or retard all or a significant part of the fluid volume, ultimately causing the incoming fluid to accumulate in and ultimately flood the street or highway. In order to minimize such occurrences of flooding, it is necessary to expend considerable effort and cost to remove the lodged trash from the downstream portions of the drainage system. Therefore, it is desirable to minimize the volume of trash that is permitted to pass through the catch basin, in order to reduce the frequency needed for cleaning such materials out of the drainage system.

It may be observed that most curb inlets and surface grates have no effective means for blocking the entry of trash. Even if they do, the blocking mechanism may permit the passage of trash into the catch basin during heavy-flow conditions. There have been ideas put forward that involve installation of catch basin filtering devices. But typically those devices cover a relatively small area within the catch basin and have a relatively small capacity for retaining trash before they overflow (along with any incoming trash). The overflowing trash then is able to collect at the entrance to the catch basin drain pipe and (if not stopped at the pipe entrance) in downstream portions of the drainage system, thus congesting the flow of fluid into and through the drainage system.

Presumably, the existing devices have been made as large as was deemed possible to also meet requirements such as cleanability (generally by providing a means for manually removing the device for cleaning out the accumulated trash) and minimal interference with the entering flow of fluid. Also, those devices may require that some portion of them be placed in or be accessible through the inlet to the catch basin, either for purposes of, for example, operation of the filter device or removal of the device when it becomes filled or congested by trash.

Thus, the existing (generally small capacity) catch basin trash filters have not been able to fully resolve the problems of retaining large amounts of trash, avoiding significant interference with the volume of fluid flowing into the drainage system, and maintaining an unobstructed catch basin inlet opening for possible installation therein of other trash impeding devices. Very little protection is afforded by the existing catch basin filters against trash clogging the drainage system during incidents of large amounts of fluid (and trash carried with the fluid) entering the catch basin. (See, e.g., U.S. Pat. No. 5,232,587, issued to Hegemier, et al. on Aug. 3, 1993; and, U.S. Pat. No. 5,643,445, issued to Billias, et al. on Jul. 1, 1997.)

The present invention provides advantages not afforded by the relevant prior art and does so in a manner that appears both unanticipated by and inconsistent with suggestions in the relevant prior art.

SUMMARY OF INVENTION

The present invention relates to an apparatus for helping minimize the passage of solid materials larger than a predetermined acceptable size through a catch basin that forms part of a fluid drainage system. (Such oversized materials are also referred to herein as "trash," and are further described in the BACKGROUND OF THE INVENTION section.) Said catch basin typically has inner walls, a floor, a ceiling, an inlet opening, and a drain opening. The invention also relates to the configuration of the apparatus within the catch basin. In accordance with one aspect of the invention, the apparatus in combination with the catch basin, includes a trash collecting container and a diverter, the container having a container bottom and container walls with the container walls comprising at least part of at least one inner wall; the container bottom comprises at least one bottom filter sheet (filter sheet), the filter sheet having a plurality of apertures through it; the container walls include at least one overflow wall located between the at least one filter sheet and an overflow area; and, at least one diverter located and oriented for diverting at least some inflowing fluid-borne trash away from the overflow area and toward the at least one filter sheet. The one or more filter sheets cover all or a substantial proportion of the floor area that is not under the overflow area, and are located above the floor a sufficient amount to provide clearance for fluid to flow along the floor and into the drain opening. The overflow wall has a top, a bottom, a filter-side surface, and an overflow-side surface. The bottom of the overflow wall is connected or proximate to the container bottom which as noted above comprises at least one filter sheet, with the overflow wall's filter-side surface facing generally toward the portion of the catch basin containing at least one of the filter sheets comprised by the container bottom and the overflow-side surface facing generally toward the overflow area. The overflow wall is located and oriented to permit fluid and trash from the filter side to flow over the overflow wall into the overflow area when the capacity of the apparatus to hold unfiltered fluid is exceeded (which capacity can vary with the accumulation of trash).

The present invention also relates to all embodiments of such an apparatus.

An object of the present invention is to provide an apparatus that minimizes the volume of trash that is permitted to pass through a catch basin Another object of the present invention is to provide an apparatus that has the capacity to retain a large amount of trash with minimum reduction in the volume of fluid passing into the drainage system.

Another object of the present invention is to provide an apparatus that facilitates cleaning and maintenance by supporting the weight of maintenance personnel when they enter a catch basin for such purposes.

Another object of the present invention is to provide an apparatus that does not require any obstruction within a curb inlet opening, so that said curb inlet opening is left available for installation of other trash impeding devices.

Another object of the present invention is to minimize the frequency needed for cleaning trash out of the portions of the drainage system downstream of a catch basin.

Another object of the present invention is to provide an apparatus for performing the functions described or shown herein that can be made of strong and durable materials.

Another object of the present invention is to provide such an apparatus that is simple and economical to make, transport, and install.

Another object of the present invention is to provide such an apparatus that can be installed using readily-available and effective means for connecting it to the catch basin and for connecting its components to one another.

Another object of the present invention is to provide such an apparatus that is sufficiently adaptable for installation into many different types of catch basins and similar environments.

Another object of the present invention is to provide such an apparatus that has the capability of adding or subtracting components or being combined with other such apparatuses to suit differing installation requirements.

Another object of the present invention is to provide such an apparatus that, where necessary or convenient, can be brought to the installation site in parts for insertion into and assembly within the catch basin.

BRIEF DESCRIPTION OF THE DRAWINGS

The present invention will be more clearly understood by reference to this specification in view of the accompanying drawings, in which.

DETAILED DESCRIPTION OF PREFERRED EMBODIMENTS

As used throughout this specification, unless expressly stated otherwise, the following terms have the definitions referred to or specified in this paragraph. The term "apparatus" is used as a generic term meaning any physical embodiment of the present invention. The term "embodiment" means embodiment of the apparatus. The term "trash" has the meaning given to it in the BACKGROUND OF THE INVENTION section, with the predetermined size being whatever size of trash the user of the apparatus wishes to prevent from passing to the downstream side of the installed apparatus (with due consideration to the fact that some trash that is non-rigid or that has a dimension smaller than the predetermined size might not be blocked). The term "the user" includes any person or organization having responsibility for making a decision on behalf of a current or prospective user of the apparatus, with regard to the particular issue presented herein for consideration by the user. The term "fluid" has the definition set forth in the BACKGROUND OF THE INVENTION section. The terms "left" and "right" are intended to mean such directions as viewed from the center of the street along a direction perpendicular to the direction of the street. The term "front," when referring to any part of an object, means the part of the object that is closer to the center of the street, and the term "back" means the part of the object that is farther from the center of the street. The terms "vertical" and "horizontal" are intended to include directions that are substantially vertical and substantially horizontal, respectively. The term "described or shown" is intended to include "described and shown." References to "herein" include the drawings as well as the other sections of this specification.

Figure 1:
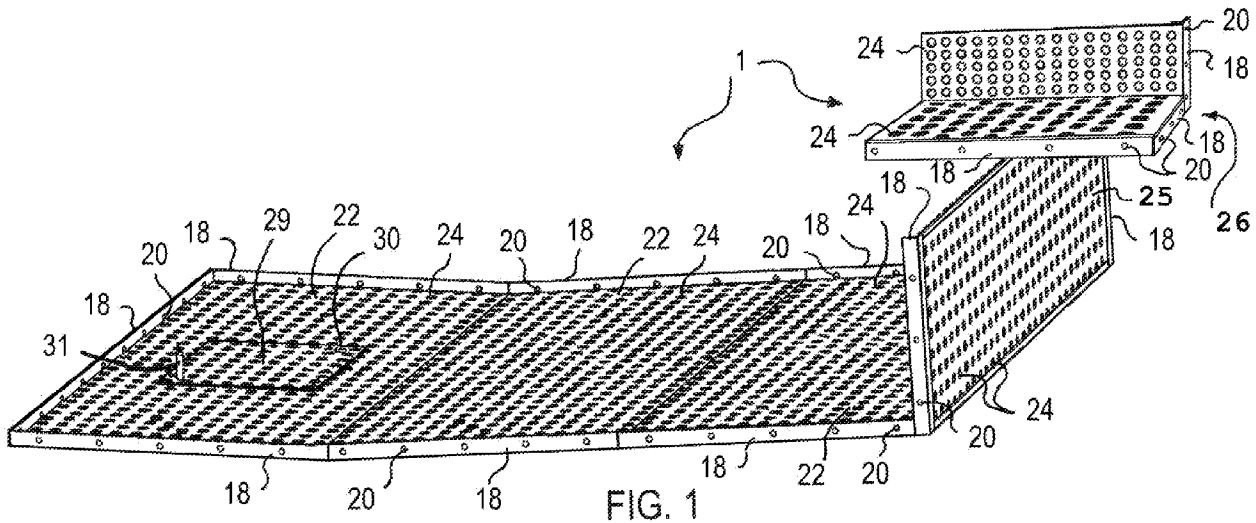
FIG. 1 is a perspective view of a preferred embodiment of the invention apparatus, which embodiment is adapted for attachment to the inner walls of a street storm-water catch basin having a curb inlet opening and a left-located drain opening, as seen without the catch basin but as it would appear if the component parts that are to be installed in the catch basin were assembled into their as-installed configuration prior to the invention's installation. (Although, in practice, at least some of this assembly could, and generally would, be done, or redone, within the catch basin during the installation.)

Referring to the drawings, FIGS. 1–6 show a first preferred embodiment, referred to herein as a left-drain filter 1, as it would appear in an installation configuration but (as illustrated in FIG. 1) without being installed in any catch basin and (as illustrated in FIGS. 2–6) after being installed into a left-drain catch basin 2. The left-drain filter 1 is configured for installation into the left-drain catch basin 2, which has a floor 3 and a drain opening 4 in the left portion of the floor 3. The left-drain catch basin 2 is designed for fluid to enter through a curb-inlet opening 5 and to exit through the drain opening 4 located in the left portion of the catch basin.

Figure 7:
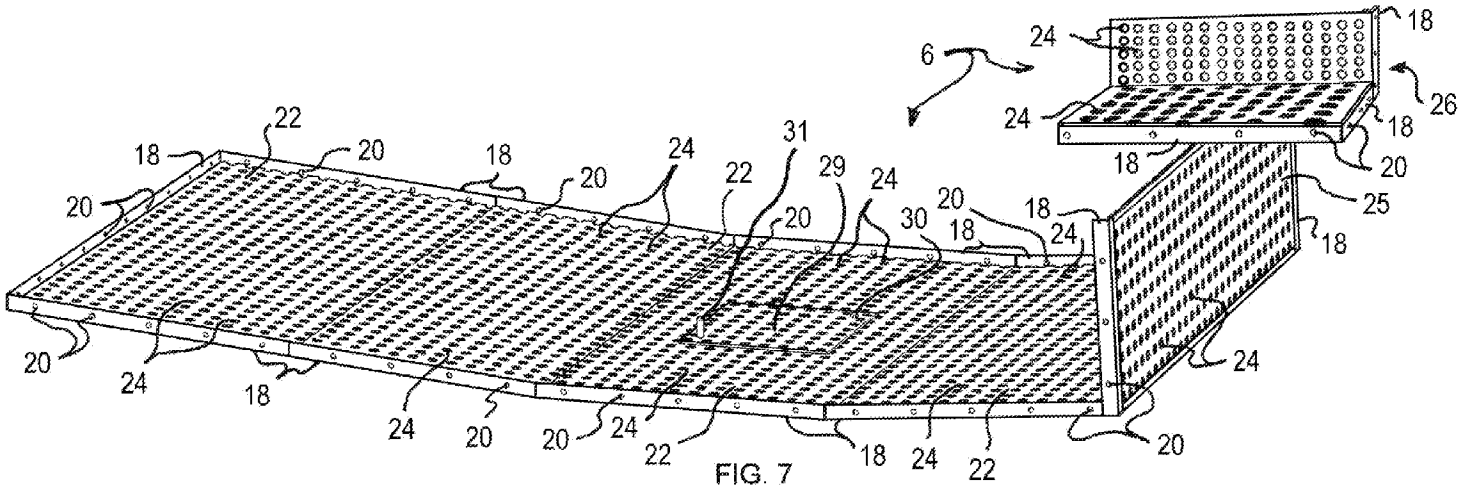
FIG. 7 is a perspective view of a second preferred embodiment of the invention apparatus, which embodiment is adapted for attachment to the inner walls of a catch basin having a curb inlet opening and center-located drain opening, as seen without the catch basin but as it would appear if the component parts that are to be installed in the catch basin were assembled into their as-installed configuration prior to the invention's installation. (Same parenthetical note as in the above brief description of FIG. 1.)
Figure 8:
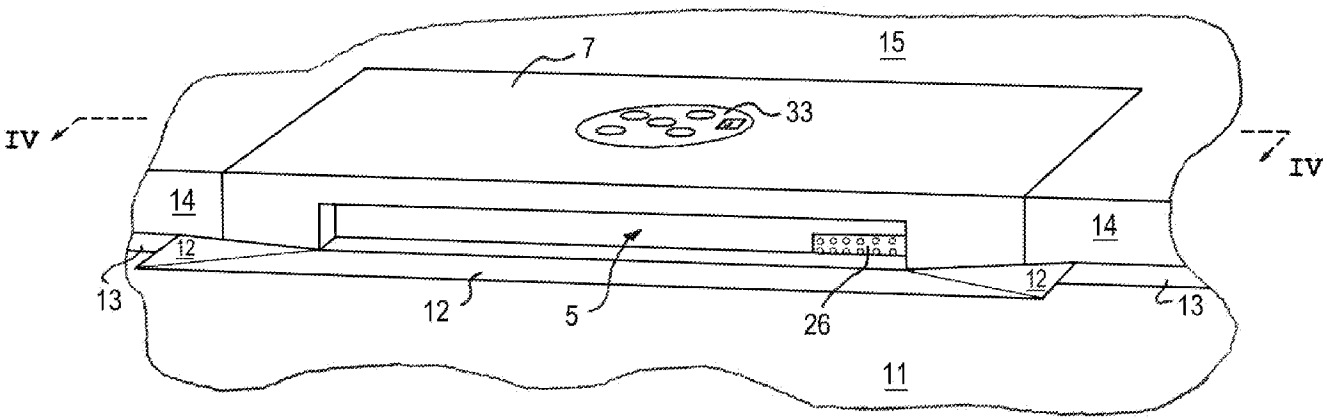
FIG. 8 is a perspective view of a catch basin in which the preferred embodiment seen in FIG. 7 is installed, showing only the part of the apparatus that is visible from this view, said part being the diverter (a portion of it visible through the curb inlet opening), and showing a manhole directly above the location of the catch basin's drain pipe opening.
Figure 9:
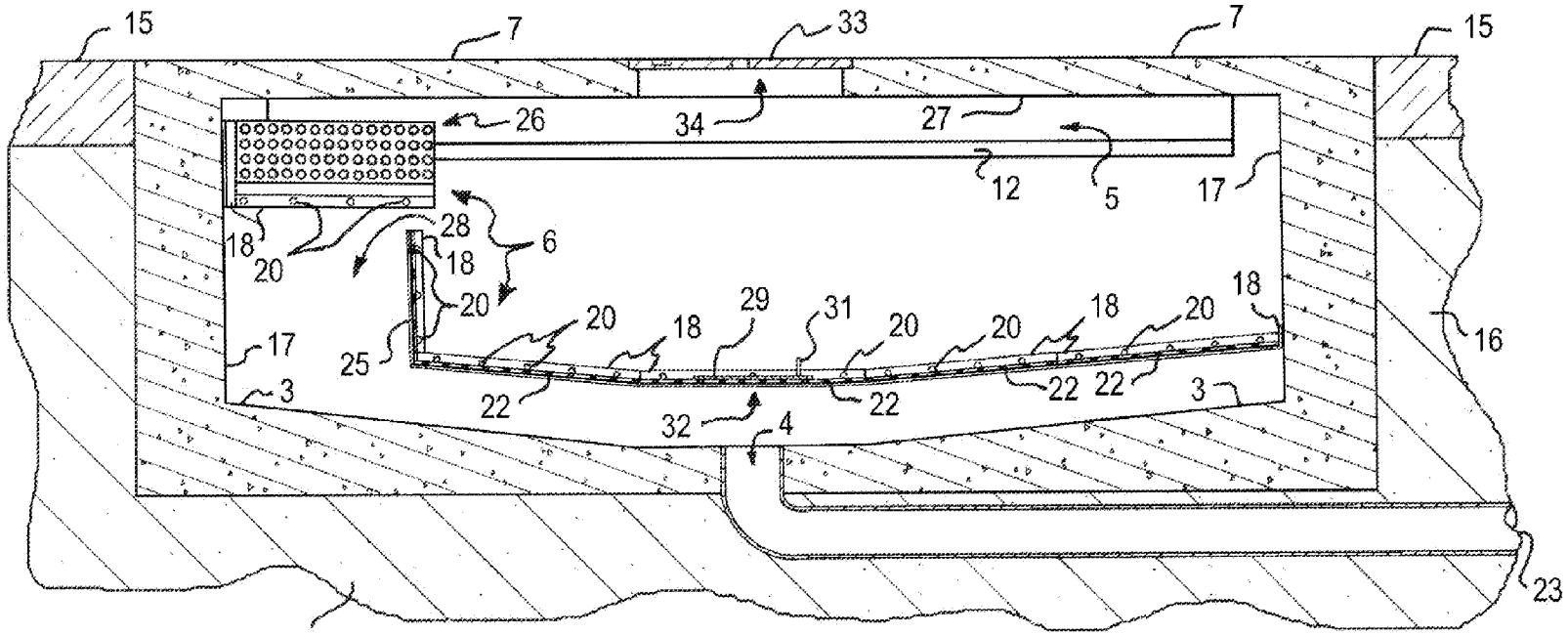
FIG. 9 is a back view of the embodiment in FIG. 7 after it has been installed, as seen through vertical cross-sectional cut IV—IV.

FIGS. 7–9 show a second preferred embodiment, referred to herein as a center-drain filter 6, as it would appear in its installation configuration but (as illustrated in FIG. 7) without being installed in any catch basin and (as illustrated in FIGS. 8–9) after being installed into a center-drain catch basin 7. The center-drain filter 6 is configured for installation into the center-drain catch basin 7, which is designed for fluid to enter through the curb-inlet opening 5 and to exit through its drain opening 4 located in the central portion of the catch basin.

Figure 10:
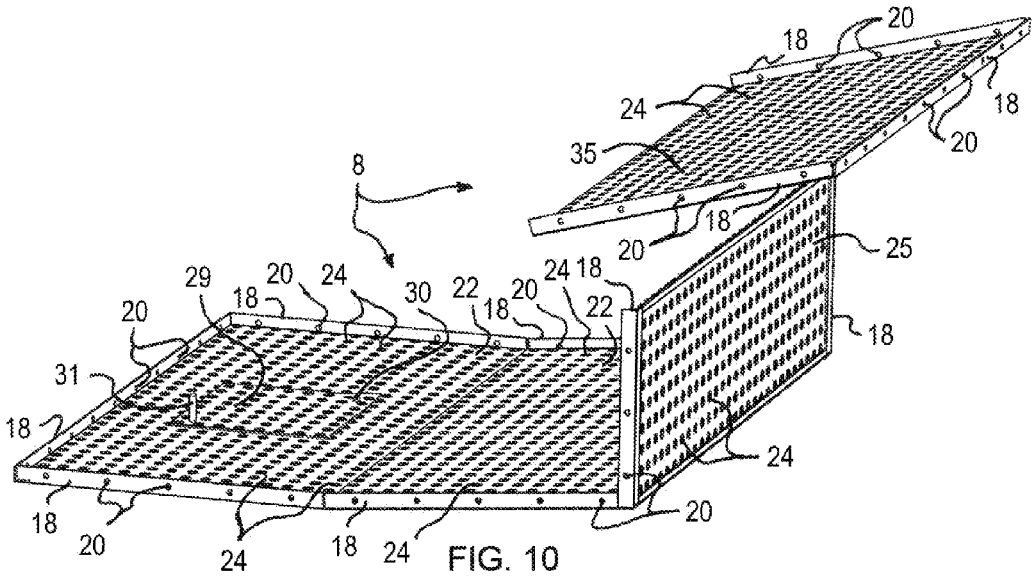
FIG. 10 is a perspective view of a third preferred embodiment of the invention apparatus, which embodiment is adapted for attachment to the inner walls of a catch basin having a top inlet opening and a left-located drain pipe opening, as seen without the catch basin but as it would appear if the component parts that are to be installed in the catch basin were assembled into their as-installed configuration prior to the invention's installation. (Same parenthetical note as in the above brief description of FIG. 1.)
Figure 11:
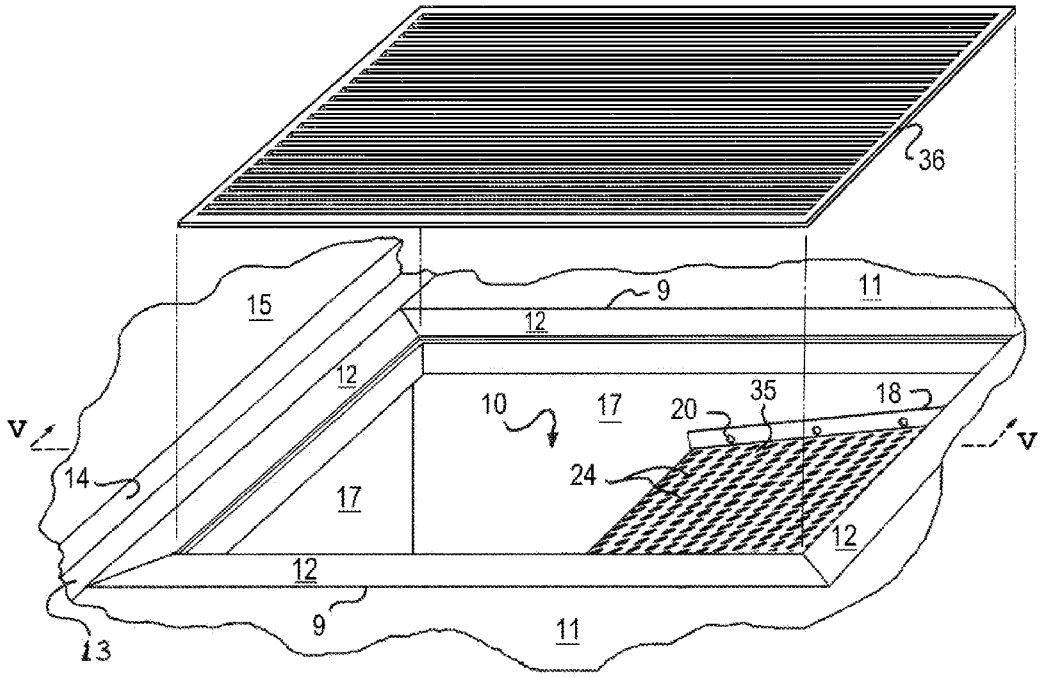
FIG. 11 is a perspective view of a catch basin in which the preferred embodiment seen in FIG. 10 is installed, showing only the part of the apparatus that is visible in this view, said part being the diverter (a portion of it is visible through the top inlet opening, with the surface grate that normally covers the opening lifted above its normal position), and showing the top inlet opening being large enough to eliminate the need for a manhole.
Figure 12:
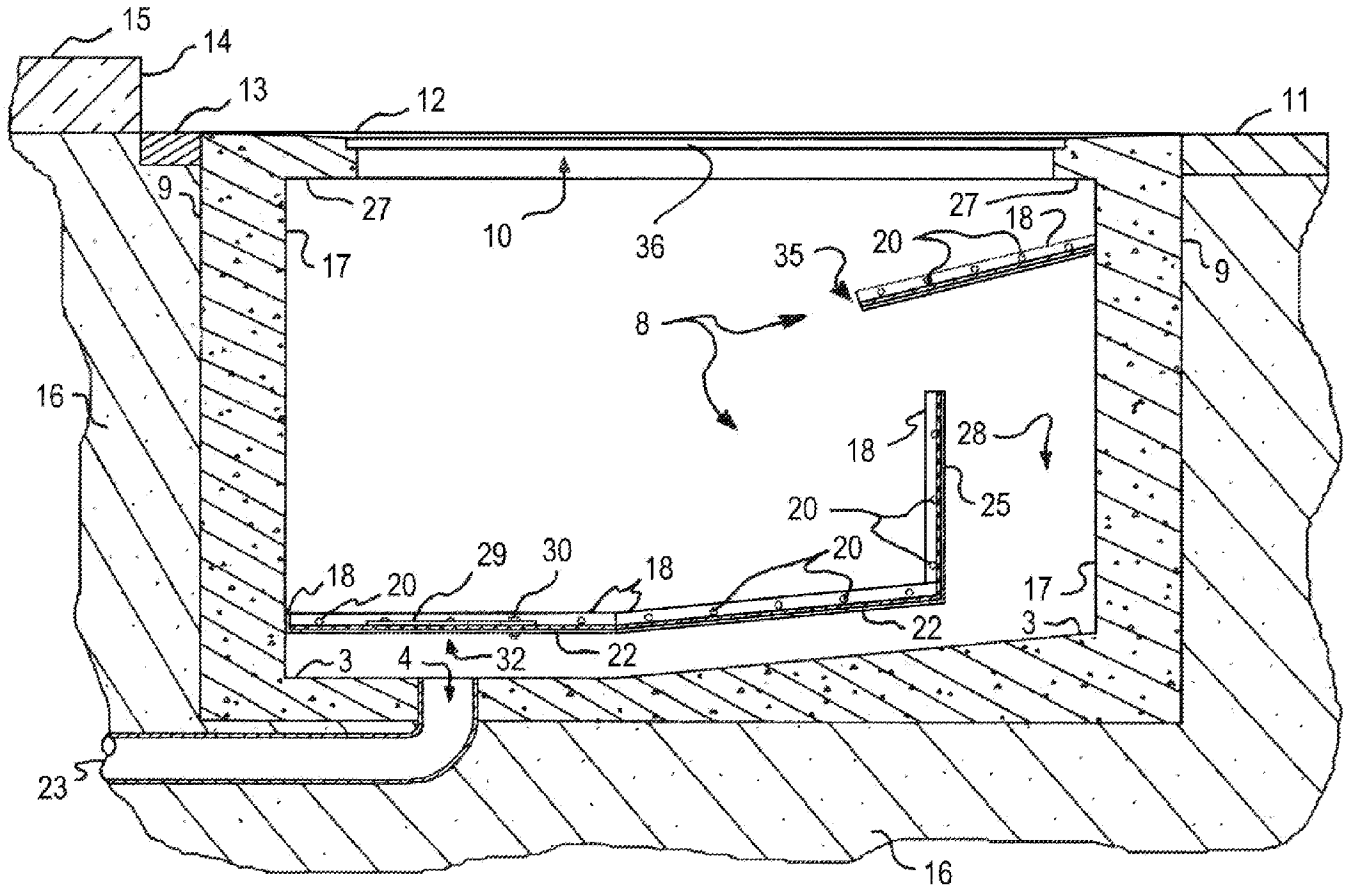
FIG. 12 is a left side view of the embodiment in FIG. 10 after it has been installed, as seen through vertical cross-sectional cut V—V. (Note that "left" is defined herein to be left when viewing from the center of the street.)

And, FIGS. 10–12 show a third preferred embodiment, referred to herein as a top-inlet filter 8, as it would appear in its installation configuration but (as illustrated in FIG. 10) without being installed in any catch basin and (as illustrated in FIGS. 11–12) after being installed into a top-inlet catch basin 9. The top-inlet filter 8 is configured for installation into the top-inlet catch basin 9, which is designed for fluid to enter through a top-inlet opening 10 and to exit through its drain opening 4 located, in this embodiment, in the back portion of the catch basin.

In FIGS. 2–6, 8–9, and 11–12, the installation environment is shown as comprising a street 11 connected to an inlet apron 12 and a gutter 13, with a curb 14 connecting the gutter to a sidewalk 15 supported on an earthen foundation 16. The inlet apron 12 shown in FIGS. 11–12 is part of the catch basin, whereas the inlet apron 12 can, alternatively, be a separate piece as shown in FIGS. 2–6 and 8–9. However, all inlet aprons 12 shown in the accompanying figures receive fluid (and any trash carried with the fluid) from the street and the gutter, and direct the fluid (and trash) into the catch basin by sloping downwardly toward the catch basin inlet opening.

Although the apparatus can be adapted to accommodate catch basins with a different number of inner walls, each catch basin shown in the accompanying figures has four inner walls 17. The apparatus is shown installed in each of those catch basins by using angle-iron supports 18 with support bolts 19 passing through bolt holes 20 in a flange of the support 18 and into anchors 21 that have been placed in three of the inner walls 17 of each catch basin. (It should be understood that, although the support bolts 19 and anchors 21 are shown only in FIG. 6, support bolt 19 and anchor 21 combinations are located approximately equally spaced apart along the flange of each installed support 18 that is in direct contact with an inner wall 17. Locations intended for said support bolt 19 and anchor 21 combinations are shown in the accompanying figures simply by showing the locations of the bolt holes 20 where practical to do so on the scale of those figures. Due to the large quantity of them, only a few of the locations of the bolt holes 20 are identified by reference number. It is believed that those skilled in the art understand or can readily determine the appropriate number and locations for the bolts and their anchors, and the size and other characteristics of them, for securing supports within a catch basin.)

Filter sheets 22 can then rest upon the supports (or, preferably, be secured by any conventional means such as screwing the filter sheets 22 into the supports 18), preferably with the plane of each filter sheet 22 located at a predetermined appropriate level above the floor 3 and oriented substantially parallel to the part of the floor 3 that is directly beneath the filter sheet 22. The appropriate level preferably provides at least enough clearance to permit a sufficient volume of fluid to flow along the floor 3 into the drain opening 4 to match the capacity of the drain opening 4. The capacity of the drain opening 4 is limited by such things as its size and the characteristics of the drain pipe 23 being used. The appropriate level also can be based on other criteria as desired by the user. Such other criteria may include factoring in the volume and quantity of trash that is likely to overflow and pass with the fluid into the space between the floor 3 and the one or more filter sheets 22. Of course, any conventional means may be used for supporting and securing the filter sheets 22 in their positions.

As best seen in FIGS. 1, 3, 4–7, & 10, the filter sheets 22 have a plurality of apertures 24 through them, so that fluid will pass through while trash will be retained for subsequent removal. (Note that due to the large quantity of them, only a few of the apertures 24 shown in the accompanying figures are identified by reference number. And, of course, the apertures 24 are to be distinguished from the circles shown on the supports 18, which only illustrate that the support bolts 19 are located and preferably equally spaced apart along the vertical flange of the supports 18.) The size and shape, pattern, combination, and other selectable features for the apertures 24 are contemplated by the present invention as being optional to the user, depending on the particular results he or she may desire. It is believed, however, that apertures 24 ranging in size (measured as the smallest dimension across the opening) from ¼ inch to 1½ inches work well for blocking the passage of trash into municipal street storm-water catch basins. Of course, larger or smaller apertures, or combinations of apertures, may be used without departing from the present invention.

Figure 2:
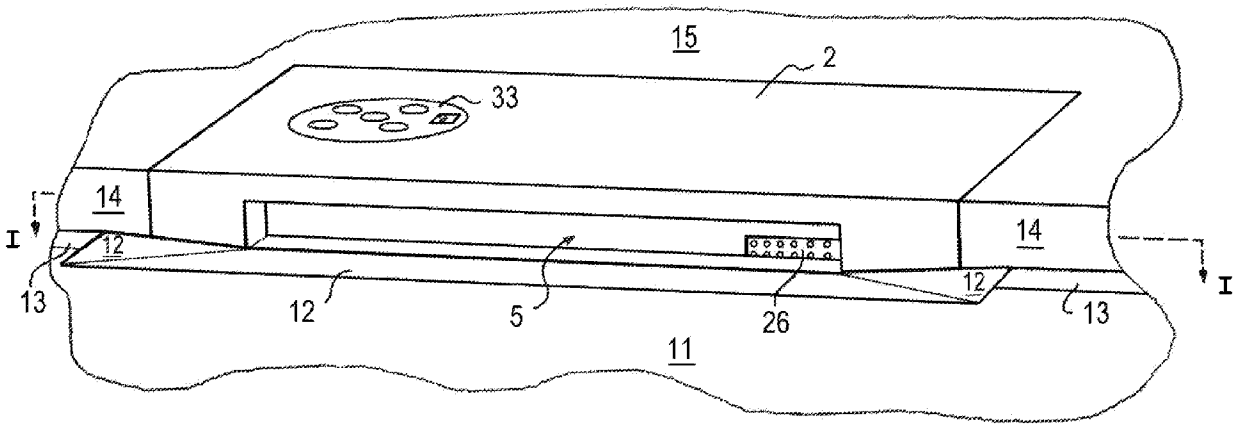
FIG. 2 is a perspective view of a catch basin in which the embodiment seen in FIG. 1 is installed, showing only the part of the apparatus that is visible from this view, said part being the diverter (a portion of it visible through the curb inlet opening), and showing a manhole cover that is located directly above the catch basin's drain opening.

FIG. 1 shows an overflow wall 25 and a curb-inlet diverter 26. As shown, the curb-inlet diverter 26 comprises two sheets secured together at right angles (by, for example, using screws to secure one edge of one sheet to one flange on a section of angle iron and to secure one edge of the other sheet to the other flange). When installed into the left-drain catch basin 2, the curb-inlet diverter 26 is oriented to form a channel that diverts incoming fluid and trash to the filter side of the overflow wall 25 (which is the side opposite the overflow area 28). As seen in FIG. 2, the curb-inlet diverter 26 is located against the inner wall 17 on the front side of the left-drain catch basin 2, generally by securing it in a manner similar to the one used for securing the filter sheets. And, the curb-inlet diverter 26 is the only part of the left-drain filter 1 that might easily be seen from the street 11. The preferable location for the curb-inlet diverter 26 is at or near the upstream end of the catch basin. Also, as is shown by a close look at FIGS. 1–2, 4, & 7–9, the curb-inlet diverter 26 is sloped slightly downwardly as it extends toward the filter side of the overflow wall 25, which helps keep the diverter clear of accumulated trash. Of course, the degree of the slope can, in other embodiments, vary depending on anticipated flow conditions and other criteria, as desired by the user. Note further, that the overflow wall 25 and the curb-inlet diverter 26 are preferably made of the same material as the filter sheets are made of, with apertures, so that the filtering process can occur at the diverter and overflow wall as well as at the filter sheets. Again, however, other embodiments may utilize other materials for construction of the overflow wall and/or the diverter without departing from the present invention.

Figure 3:
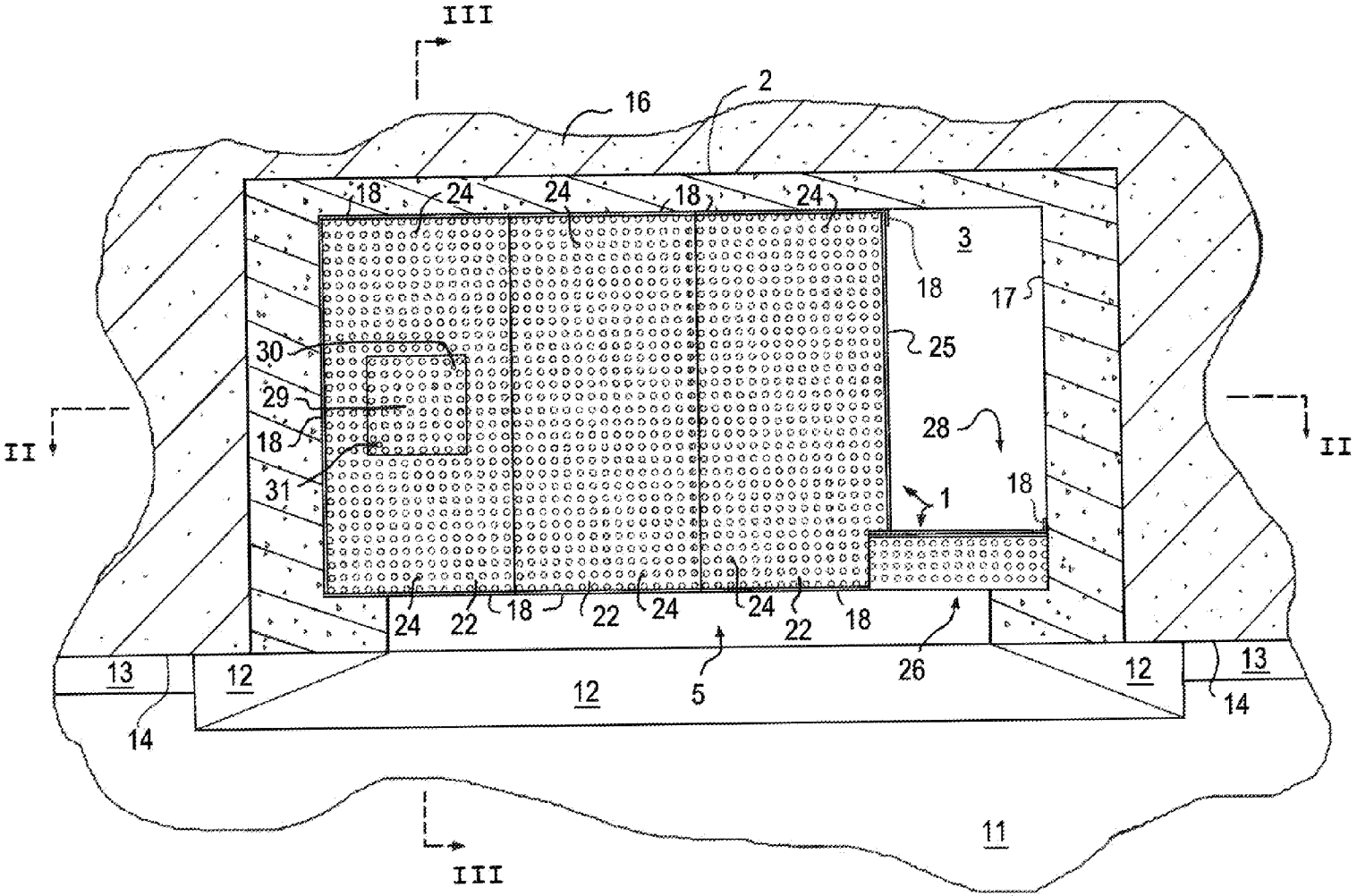
FIG. 3 is a top view of the embodiment in FIG. 1 after it has been installed, as seen through horizontal cross-sectional cut I—I.
Figure 4:
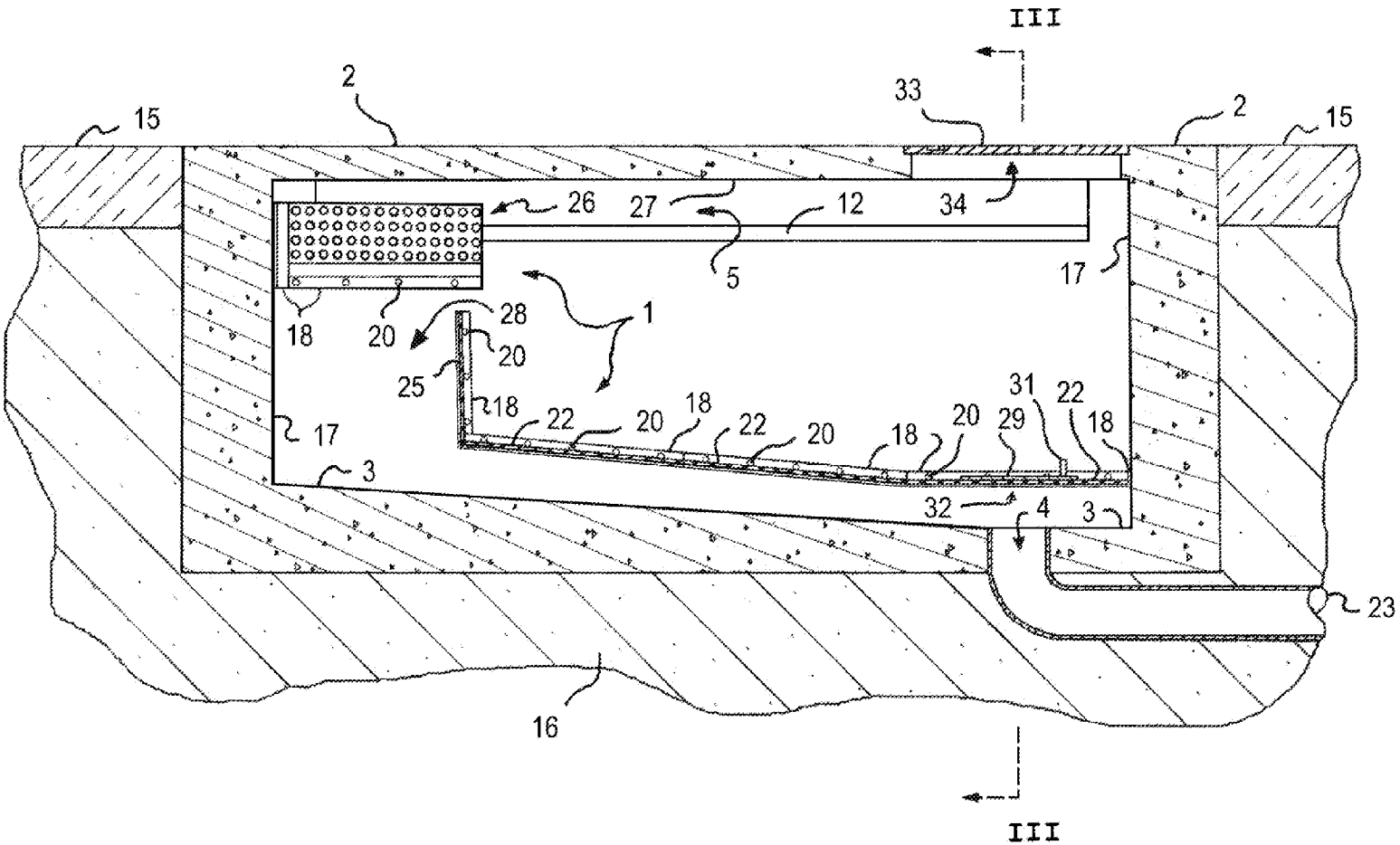
FIG. 4 is a back view of the embodiment in FIG. 1 after it has been installed, as seen through vertical cross-sectional cut II—II.
Figure 5:
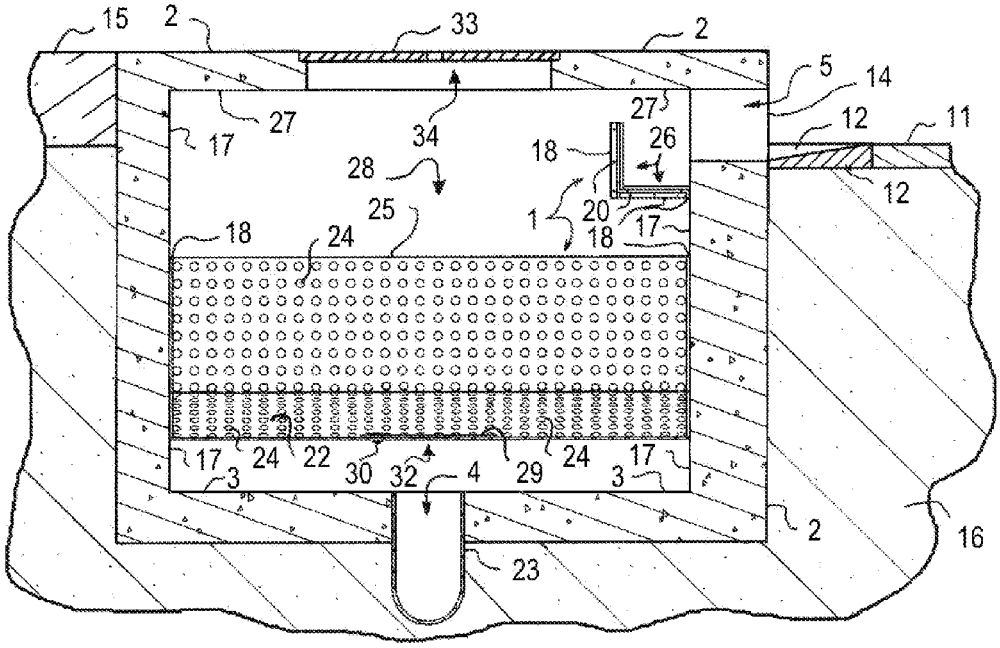
FIG. 5 is a left side view of the embodiment in FIG. 1 after it has been installed, as seen through vertical cross-sectional cut III—III.

FIG. 3 looks down through sectional cut l—l, which is a substantially horizontal cut immediately below the inside ceiling 27 of the left-drain catch basin 2. In FIG. 3, the curb-inlet diverter 26 is seen as being secured to the inner walls 17 on the front and right sides of the left-drain catch basin 2. The space between the overflow wall 25 and the inner wall 17 on the right side of the catch basin forms an overflow area 28, into which fluid and trash can overflow from the filter side of the overflow wall 25 when the capacity of the filter is exceeded. Under those circumstances, as seen in FIGS. 4, 5, 9, and 12, overflowing fluid and trash is able to flow along the floor 3 beneath the filter sheets 22 and enter the drain pipe 23.

FIG. 3 also illustrates the large area coverage of the filter sheets 22, which, preferably, form a snug fit to the inner walls 17 on the front, left, and back sides of the catch basin. In this embodiment the filter sheets 22 are bounded by the three inner walls 17 and the overflow wall 25 and preferably cover approximately 80 percent of the floor 3, thereby providing a very large filtering and holding capacity. Although no top view of the other embodiments, which are the subjects of FIGS. 7–12, is shown, FIG. 3 is illustrative of the capacity the other embodiments provide by also having filter sheets 22 fully cover the floor area on the filter side of the overflow wall 25. Of course, additional embodiments not specifically described or shown herein may cover different proportions of the floor area without departing from the present invention.

Figure 6:
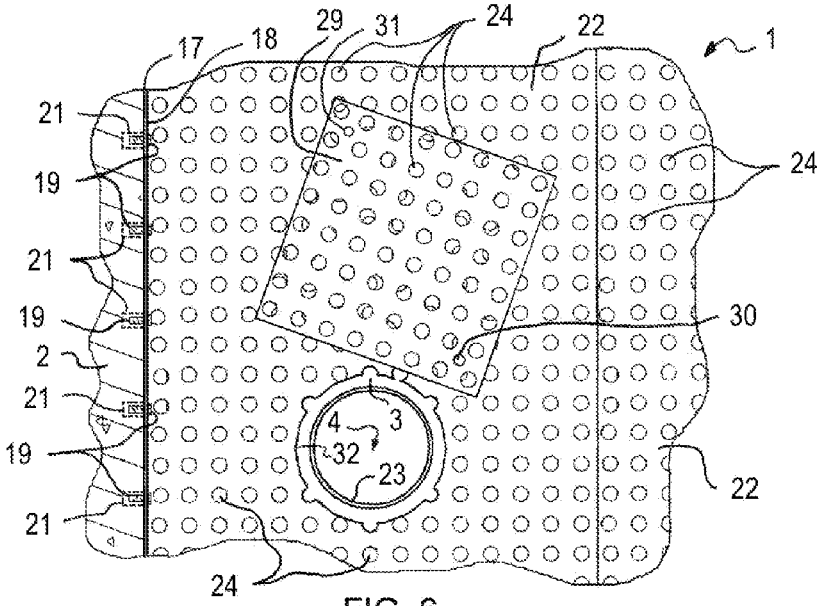
FIG. 6 is a close up top view of a portion of the embodiment in FIG. 1 after it has been installed, as seen through horizontal cross-sectional cut I—I, showing the filter hole cover in an open position.

FIG. 3 also shows a filter hole cover 29 in its closed position, which filter hole cover 29 has a pivot bolt 30 and a handle 31 to facilitate rotation of the filter hole cover 29 into its open position to expose a filter hole 32, as illustrated in FIG. 6. Preferably, the filter hole 32 is directly above the drain opening 4, where the drain pipe 23 commences. An embodiment having the filter hole 32 and the filter hole cover 29 is preferable to an embodiment not having them, since the drain pipe 23 must occasionally be accessed and cleaned. To do this, maintenance personnel generally must gain access to the drain pipe 23 by removing the manhole cover 33 and introducing clean out equipment into the catch basin through the manhole 34. If there is a filter hole 32 and filter hole cover 29, maintenance personnel can easily access the drain pipe 23 by moving the filter hole cover 29 to an open position, whereas they would otherwise generally need to move an entire filter sheet 22. Preferably the filter hole 32 and the manhole 34 are located directly above the drain opening 4. Although, the other embodiments described or shown herein also have filter holes 32 covered by filter hole covers 29, additional embodiments may have multiple filter holes or no filter hole at all, or may have the filter hole(s) located elsewhere within the catch basin, have no filter hole cover, or have any combination thereof, without departing from the present invention.

As seen in FIGS. 7–9, the center-drain filter 6 is quite similar to the left-drain filter 1. The difference lies in the fact that the center-drain filter 6 is adapted for installation into the center-drain catch basin 7 rather than the left-drain catch basin 2. For such adaptation, the center-drain filter 6 has its lowest point located over the centrally located drain opening 4, with one or more filter sheets 22 added on the left side of the drain opening 4. Preferably, the added filter sheets slope upward, substantially parallel to the slope of the floor 3, until they reach the inner wall 17 at the left end of the center-drain catch basin 7.

The top-inlet filter 8, as shown in FIGS. 10 and 12, has a top-inlet diverter 35 rather than a curb-inlet diverter 26. The top-inlet diverter 35 preferably extends from the inner wall 17 at the front of the top-inlet catch basin 9, inwardly into the top-inlet catch basin 9 while downsloping modestly to end at a point on the filter side of the overflow wall 25. (A 2 percent to 20 percent downslope is believed preferable, but the present invention encompasses milder and steeper downslopes that may be deemed more suitable by the user.) Preferably, the top-inlet diverter 35 also extends laterally to cover the entire overflow area 28, with the top-inlet diverter 35 reaching several inches beyond the overflow wall 25 to help assure trash is not allowed to directly enter the overflow area 28. The top-inlet diverter 35 also is shown as being separated vertically from the top of the overflow wall 25 to provide sufficient space between the top-inlet diverter 35 and the overflow wall 25 for fluid and trash to overflow the top-inlet filter 8 via the overflow wall 25 without significant impediment by the top-inlet diverter 35.

Like the curb-inlet diverter 26, the top-inlet diverter 35 works to divert incoming trash away from the overflow area 28 to the filter side of the overflow wall 25. Also, the top-inlet diverter 35 preferably is made using the same material, with apertures, as is used for making the filter sheets 22, so that the filtering process begins as the entering fluid and trash impact the top-inlet diverter 35. (The same preference for use of material with apertures applies to the overflow wall and the diverter in other embodiments. For example, this preference is discussed and applied above with respect to the left-drain filter 1, shown in FIGS. 1–6, and is also intended to apply to the center-drain filter 6, shown in FIGS. 7–9.)

As shown in FIGS. 11 and 12, a large surface grate 36 can be located in the top-inlet opening 10, within the street environment, to facilitate handling large volumes of fluid and to allow access by maintenance personnel into the top-inlet catch basin 9 without need for a manhole.

The supports 18, filter sheets 22, the other parts of the apparatus, and the means for connecting them together and securing them to the inner walls 17 are, preferably, made of hot dipped galvanized steel, although they can be made of any other conventional material that is strong and durable in the presence of the fluids reasonably expected to pass through the catch basin in which they are installed, with due consideration to the potential for corrosion and/or electrolysis particularly when using more than one type of metal in the construction of the apparatus. Such other conventional materials include stainless steel, aluminum, plastics, carbon fibers, and composites. The means for connecting the parts of the apparatus to one another or to the catch basin can be any conventional connecting means such as, without limitation, bolts, screws, welds, clamps, and/or adhesives.

The supports 18 shown herein as angle irons may be installed with the vertical side of the angle iron pointed up or down. The accompanying figures show the vertical side pointing up on the supports 18 used to support the filter sheets 22. Nevertheless, an alternative embodiment with the vertical side of the supports 18 pointing down would appear preferable in order to cause less interference between the support bolts 19 and the filter sheets 22. (A sample of this alternative orientation of the vertical side of the supports is found in the curb-inlet diverter 26 shown in FIGS. 1, 3–5, 7 & 9, which has the vertical side of the supports 18 pointing down.)

Of course, catch basins may have designs with such things as their size, shape, and/or orientation, or the location, number, and/or size of their inlet openings or drain openings being different from any of those described or shown herein. It should be understood, however, that the present invention contemplates and includes all conventional adjustments in the embodiments described or shown herein (including such adjustments in the size, orientation, proportions, and relative positioning of parts) made to accommodate those differences in catch basin designs. For example, an alternative catch basin design may provide a shelf, ledge, or groove, or combination thereof, built into one or more of its inner walls as a resting place for the supports or even for the filter sheets without supports. An embodiment adapted for installation in such a catch basin design could be made with reduced, or without any, use of other means (such as the support bolt/anchor combinations) for securing the supports and/or filter sheets, without departing from the present invention.

It is to be understood that the invention claimed is not limited to the embodiments described or shown herein, but encompasses any and all embodiments within the scope of the claims and is limited only by such claims.

What is claimed is:

1. An apparatus for filtering trash in a catch basin, wherein the catch basin comprises inner walls, a floor, an inlet opening, and a drain opening, and wherein said apparatus in combination with the catch basin comprises:

a. a trash collecting container located within the catch basin, wherein the container comprises a container bottom and container walls, wherein the container bottom comprises a filter sheet, the filter sheet comprising a plurality of apertures through it, wherein the container bottom is located above at least part of the floor, and wherein said container walls comprise an overflow wall and one or more container portions of inner wall, each container portion of inner wall being at least part of at least one of the container walls and cmprising at least part of at least one of the one or more inner walls, wherein the overflow wall is located between the filter sheet on the inside of the container and an overflow area on the outside of the container, wherein the overflow area is bounded on one side by the overflow wall and on another side by at least one non-container portion of inner wall, the non-container portion of inner wall being located outside the container and comprising at least part of at least one of the one or more inner walls, wherein at least a portion of the top of the overflow wall is located for allowing at least some of the trash to pass out of the container ovber the overflow wall and thence downwardly through the overflow area to the floor, and wherein there is sufficient space between the floor and the container bottom for at least some of the trash that has passed out of the container over the overflow wall, after reaching the floor, to thence move through said space to the drain opening; and, b. a diverter, wherein said diverter is located and oriented relative to the inlet opening for intercepting at least some inbound fluid-borne trash and diverting at least some intercepted trash away from a first direction, the first direction being a direction leading outside the container, and toward a second direction, the second direction being a direction for at least some diverted trash to cross at least part of the overflow wall for entering the container, wherein the inbound fluid-borne trash is the trash being moved by the fluid from a point outside the catch basin toward a point inside the catch basin and wherein the intercepted trash is the inbound fluid-borne trash intercepted by the diverter, the diverted trash being the intercepted trash diverted by the diverter.

2. The apparatus of claim 1, wherein the one or more container portions of inner wall comprise a container portion of inner wall on the front side of the catch basin and a container portion of inner wall on the back side of the catch basin.

3. The apparatus of claim 2, wherein the diverter comprises a plurality of apertures through it.

4. The apparatus of claim 2, wherein the one or more container portions of inner wall further comprise a container portion of inner wall on the right or left side of the catch basin.

5. The apparatus of claim 1, wherein the diverter comprises a plurality of apertures through it.

6. The apparatus of claim 1, wherein the diverter is a curb-inlet diverter and wherein the second direction deviates sideways from the first direction.

7. The apparatus of claim 1, also comprising a filter hole, wherein the filter hole passes through the container bottom, wherein the drain opening leads to a catch basin drain, wherein the filter hole is large enough to accomodate insertion through it of a predetermined size of drain clean-out equipment and wherein the filter hole location in the installed apparatus if close enough to the drain opening for the clean-out equipment to be inserted through the filter hole and placed at least operably close to the drain opening for cleaning out at least part of the drain.

8. The apparatus of claim 7, also comprising a filter hole cover, wherein the filter hole cover is movably connected to the container bottom, and wherein the filter hole cover is movable from a closed position that covers at least part of the filter hole to an open position that uncovers the filter hoe enough for the clean-out equipment to be inserted through the filter hole.

9. The apparatus of claim 1, wherein cross comprises pass through.

10. An apparatus for filtering trash in a catch basin, the apparatus in combination with the catch basin comprising:

a. a trash collecting container located within the catch basin, the catch basin comprising an inlet opening, one or more inner walls, a floor, and a drain opening, wherein the container comprises a container bottom and container walls, wherein the container bottom comprises at least one filter sheet, the filter sheet comprising a plurality of apertures through it, said apertures through the filter sheet being of a size and shape that will allow fluid to pass through the filter sheet but block such passage of at least some trash, wherein the filter sheet is located above at least part of the floor and higher than the lowest part of the drain opening, and wherein the container walls form the lateral bounds of the container and comprise an overflow wall and at least part of at least one of the one or more inner walls, wherein the overflow wall comprises an overlow wall top, wherein at least part of the overflow wall top defines an overflow level, the overflow level being a level selected for allowing at least some of the trash to escape the container over the overflow wall top;

b. a relief channel for channeling overflow trash, the relief channel being located within the catch basin but outside the container, and overflow trash being the trash thet overflows the overflow wall top, wherein the relief channel encloses an overflow area for receiving at least some of the overflow trash from the overflow wall top, and wherein the minimum inside dimensions of the relief channel are large enough to allow passage of at least some of the overflow trash from the overflow area to the drain opening; and, c. a diverter, wherein the diverter is located and oriented for intercepting at least some entering trash and for diverting at least some intercepted trash away from a first direction, the first direction being a direction leading to a point outside the container, and toward a second direction, the second direction being a direction for at least some diverted trash to cross at least part of the overflow wall for entering the container, wherein the entering trash is the trash moving in an inbound direction, inbound direction being a direction leading from the inlet opening into the catch basin, and wherein the intercepted trash is the entering trash intercepted by the diverter, the diverted trash being the intercepted trash diverted by the diverter.

11. The apparatus of claim 10, wherein the one or more inner walls comprise two opposing inner walls wherein the two opposing inner walls are on opposing sides of the catch basin, and wherein the at least part of the one or more inner walls comprised by the container walls includes at least part of each of the two opposing inner walls.

12. The apparatus of claim 11, wherein the diverter comprises a plurality of apertures through it, said apertures through the diverter being of a size and shape that allows the fluid to pass through the diverter but blocks such passage of at least some trash.

13. The apparatus of claim 11, wherein the one or more inner walls further comprise a third inner wall, and wherein the at least part of at least one of the one or more inner walls comprised by the container walls further includes at least part of the third inner wall.

14. The apparatus of claim 10, wherein the diverter comprises a plurality of apertures through it, said apertures through the diverter being of a size and shape that allows the fluid to pass through the diverter but blocks such passage of at least some trash.

15. The apparatus of claim 10, also comprising a filter hole, wherein the filter hole passes through the container bottom, wherein the drain opening leads to a catch basin drain, wherein the filter hole is large enough to accomodate insertion through it of a predetermined size of drain clean-out equipment and wherein the filter hole location in the installed apparatus is close enough to the drain opening for the clean-out equipment to be inserted through the filter hole and placed in a position at which the clean-out equipment can operate to clean out at least part of the drain.

16. The apparatus of claim 15, also comprising a filter hole cover, wherein the filter hole cover is connected to the container bottom, and wherein the filter hole cover is movable between a closed position wherein at least some of the filter hole is covered to an open position wherein the filter hole is uncovered at least enough for the clean-out equipment to be inserted through the filter hole.

17. The apparatus of claim 10, wherein the diverter is a curb-inlet diverter and wherein the second direction deviates sideways from the first direction.

18. The apparatus of claim 17, wherein the diverter comprises a diverter bottom and a diverter wall, wherein the diverter wall is positioned relative to the diverter bottom to form a barrier for preventing at least some of the trash that crosses over the diverter bottom from falling into the catch basin outside the container.

19. The apparatus of claim 10, wherein cross comprises pass through.

20. An apparatus for filtering trash in a catch basin, the apparatus in combination with the catch basin comprising:

a. a trash collecting container located within the catch basin, the catch basin comprising an inlet opening, one or more inner walls, a floor, and a drain opening, wherein the container comprises a container bottom and container walls, the container bottom comprising at least one filter sheet forming at least part of the container bottom, the filter sheet comprising a plurality of apertures through it, said apertures through the filter sheet being of a size and shape that will allow fluid to pass through the container bottom but block such passage of at least some trash, wherein the filter sheet is located above at least part of the floor and higher than the lowest part of the drain opening, and wherein the container walls form the lateral bounds of the container and comprise an overflow wall, wherein at least part of the top of the overflow wall defines an overflow level, the overflow level being a level selected for allowing at least some of the trash to escape the container by overflowing the overflow wall, wherein at least one of the container walls comprises a plurality of apertures through it, said apertures through said at least one of the container walls being of a size and shape that allows fluid to pass through said at least one of the container walls but blocks such passage of at least some trash, and wherein the container walls also comprise a portion of at least one of the one or more inner walls;

b. a relief channel for channeling overflow trash, the relief channel being located within the catch basin but outside the container, wherein the relief channel comprises an overflow channel and a floor channel, wherein the overflow channel receives at least some of the overflow trash, the overflow trash being the trash that overflows the overflow wall, wherein the overflow channel leads downwardly and connects with the floor channel, wherein the floor channel runs between the floor and the container bottom, and wherein the floor channel is large enough for at least some of the overflow trash to pass from the overflow channel toi the drain opening; and, c. a diverter located within the catch basin, wherein the diverter is positioned to intercept at least some netering trash, entering trash being the trash that has moved through at least part of the inlet opening in a direction toward the catch basin, wherein at least some intercepted trash would have fallen outside the container if the diverter were not present, intercepted trash being the entering trash intercepted by the diverter, wherein at least part of the diverter is located higher than at least part of the top of the overflow wall, wherein the diverter is orientated to divert at least some of the intercepted trash toward crossing at least part of the overflow wall for entering the container, and wherein the diverter comprises a plurality of apertures through it, said apertures through the diverter being of a size and shape that allows fluid to pass through the diverter but blocks such passage of at least some trash.

21. The apparatus of claim 20, wherein the diverter comprises a diverter bottom and a diverter wall, wherein the diverter wall is positioned relative to the diverter bottom to form a barrier for preventing at least some of the entering trash that crosses over the diverter bottom from falling into the catch basin outside the container.

22. The apparatus of claim 20, also comprising a filter hole, wherein the filter hole passes through the container bottom, wherein the drain opening leads to a catch basin drain, wherein the filter hole is large enough to accomodate insertion through it of a predetermined size of drain clean-out equipment and wherein the filter hole location in the installed apparatus is close enough to the drain opening to accomodate placement of the clean-out equipment through the filter hole into a position sufficiently close to the drain opening for cleaning out at least part of the drain.

23. The apparatus of claim 22, also comprising a filter hole cover, wherein the filter hole cover is movably connected to the container bottom, and wherein the filter cover is movable from a closed position that covers at least part of the filter hole to an open position that uncovers the filter hole enough for the clean-out equipment to be inserted through the filter hole.

24. The apparatus of claim 23, wherein the minimum inside dimensions of the relief channel are large enough to allow passage through the relief channel of the fluid in a volume needed to match a predetermined requirement for rate of drainage from the catch basin, and to allow passage of the trash of a size and shape that is within a predetermined requirement for trash to be permitted into the drain opening, wherein both of said predetermined requirements are limited by the maximum capacity of the drain opening and its associated drainage system.

25. The apparatus of claim 20, wherein the container walls comprise a portion of a first inner wall and a portion of a second inner wall, wherein the portion of the first inner wall is on the front side of the catch basin and the portion of the second inner wall is on the back side of the catch basin.

26. The apparatus of claim 25, wherein the container walls further comprise a portion of a third inner wall, wherein the portion of the third inner wall is on either the left or right side of the catch basin.

27. The apparatus of claim 20, wherein crossing comprises passing through.

28. An apparatus for retaining at least some trash within a catch basin, the catch basin having one or more inner walls, a floor, an inlet opening, and a drain opening, the apparatus comprising:

a. a bottom comprising a filter sheet, the filter sheet having a plurality of apertures through it for blocking the passage of at least some trash through the bottom while permitting such passage of fluid, wherein the bottom is located within the catch basin above at least part of the catch basin floor with the bottom bounded on at least one side by at least part of a catch basin inner wall;

b. an overflow wall located within the catch basin between the filter heet and an overflow area, wherein the overflow wall permits at least some of the trash that accumulates on the filter side of the overflow wall to pass over the overflow wall and thence move downwardly through the overflow area to the floor;

c. a diverter located downstream of the inlet opening for diverting at least some of the trash away from moving in a first direction and toward moving in a second direction, wherein the trash moving in the first direction would not, unless diverted sideways relative to the first direction, enter the space above the bottom, the lateral bounds of which space are defined by the lateral bounds of the bottom, and wherein at least some of the trash diverted to moving in the second direction will enter the space above the bottom by crossing the overflow wall to a location from which the trash so diverted is able to descend toward the bottom; and, d. a space between the bottom and at least part of the catch basin floor, the space being large enough for at least soem of teh trash to pass through it.

29. The apparatus of claim 28, also comprising a filter hole through the bottom and a filter hole cover, wherein the drain opening leads to a catch basin drain, and wherein the filter hole is sized and located for placement of clean-out equipment through the filter hole and into the drain opening for cleaning out at least part of the drain; and, wherein the filter hole cover is movable from a closed position that covers at leats part of the filter hole to an open position that uncovers the filter hole enough for allowing insertion of the clean-out equipment through the filter hole.

* * * * *

UNITED STATES PATENT AND TRADEMARK OFFICE

CERTIFICATE OF CORRECTION

PATENT NO. : 7,494,585 B2
APPLICATION NO. : 10/934854
DATED : February 24, 2009
INVENTOR(S) : Khalil Ibrahim Nino It is certified that error appears in the above-identified patent and that said Letters Patent is hereby corrected as shown below:

Column 7: at line 47, “1—1” should read --l—l--.

Column 9: at line 60, “comprises inner” should read --comprises one or more inner--.

Column 10: at line 5, “cmprising” should read --comprising--; at line 17, “ovber,” should read --over--; and, at line 60 (line 58 of printed text), “if” should read --is--.

Column 11: at line 1, “hoe” should read --hole--.

Column 13: at line 6, “toi” should read --to--; at line 8, “netering” should read --entering--; at line 42, “filter cover” should read --filter hole cover--; and, at line 46, “claim 23” should read --claim 20--.

Column 14: at line 24, “heet” should read --sheet--; at line 34, “the space above the bottom” should read --a space above the bottom--; at line 35, “which space” should read --which space above the bottom--; at line 43, “the space being” should read --the space between the bottom and floor being--; at line 42, “soem” should read --some--; at line 43, “teh” should read --the--; and, at line 51, “leats” should read --least--.

Signed and Sealed this
Twenty-ninth Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,494,585 B2
APPLICATION NO. : 10/934854
DATED : February 24, 2009
INVENTOR(S) : Khalil Ibrahim Nino It is certified that error appears in the above-identified patent and that said Letters Patent is hereby corrected as shown below:

Column 7: at line 47, “1—1” should read --I–I--.

Column 9: at line 60, “comprises inner” should read --comprises one or more inner--.

Column 10: at line 5, “cmprising” should read --comprising--; at line 17, “ovber,” should read --over--; and, at line 60 (line 58 of printed text), “if” should read --is--.

Column 11: at line 1, “hoe” should read --hole--.

Column 13: at line 6, “toi” should read --to--; at line 8, “netering” should read --entering--; at line 42, “filter cover” should read --filter hole cover--; and, at line 46, “claim 23” should read --claim 20--.

Column 14: at line 24, “heet” should read --sheet--; at line 34, “the space above the bottom” should read --a space above the bottom--; at line 35, “which space” should read --which space above the bottom--; at line 42, “the space being” should read --the space between the bottom and floor being--; at line 43, “soem” should read --some--; at line 43, “teh” should read --the--; and, at line 51, “leats” should read --least--.

This certificate supersedes the Certificate of Correction issued March 29, 2011.

Signed and Sealed this
Third Day of May, 2011

David J. Kappos

David J. Kappos
*Director of the United States Patent and Trademark Office*